US010196948B2

(12) United States Patent
Masui et al.

(10) Patent No.: US 10,196,948 B2
(45) Date of Patent: Feb. 5, 2019

(54) EXHAUST MUFFLER FOR COMBUSTION ENGINE

(71) Applicant: Kawasaki Jukogyo Kabushiki Kaisha, Kobe-shi, Hyogo (JP)

(72) Inventors: Kazuki Masui, Kobe (JP); Shinya Akase, Kobe (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 82 days.

(21) Appl. No.: 15/355,637

(22) Filed: Nov. 18, 2016

(65) Prior Publication Data

US 2017/0167333 A1 Jun. 15, 2017

(30) Foreign Application Priority Data

Dec. 11, 2015 (JP) ..... 2015-242579

(51) Int. Cl.

| | |
|---|---|
| ***F01N 3/02*** | (2006.01) |
| ***F01N 1/02*** | (2006.01) |
| ***F01N 1/14*** | (2006.01) |
| ***F01N 3/28*** | (2006.01) |
| ***F01N 1/08*** | (2006.01) |

(52) U.S. Cl.

CPC ..... *F01N 3/0205* (2013.01); *F01N 1/02* (2013.01); *F01N 1/026* (2013.01); *F01N 1/083* (2013.01); *F01N 1/14* (2013.01); *F01N 3/2885* (2013.01); *F01N 2230/04* (2013.01); *F01N 2260/022* (2013.01); *F01N 2260/20* (2013.01); *F01N 2470/02* (2013.01); *F01N 2470/18* (2013.01)

(58) Field of Classification Search

CPC . F01N 1/02; F01N 1/026; F01N 1/083; F01N 1/14; F01N 3/0205; F01N 3/2885; F01N 2230/04; F01N 2260/20; F01N 2470/02; F01N 2470/18

See application file for complete search history.

(56) References Cited

U.S. PATENT DOCUMENTS 2,832,430 A * 4/1958 Coombs ..... F01N 1/08 181/262
4,147,230 A * 4/1979 Ormond ..... F01N 1/003 181/231
4,444,288 A * 4/1984 Sekiya ..... F01N 1/14 181/252
5,058,704 A * 10/1991 Yu ..... F01N 1/089 181/262

(Continued)

FOREIGN PATENT DOCUMENTS

CN 201225189 Y * 4/2009
JP 05098957 A * 4/1993 ..... F01N 3/2046

(Continued)

*Primary Examiner* — Audrey K Bradley

(57) ABSTRACT

A muffler for decreasing the amount of noise of exhaust gases from a combustion engine is fluid connected with an exhaust port of an engine cylinder through an exhaust pipe. The interior of the muffler is divided into a first expansion chamber on the most upstream side, and a second expansion chamber on a downstream side thereof. The exhaust pipe is fluid connected with the muffler so as to be present within the first expansion chamber. The muffler is furthermore provided with a cooling pipe, which extends through the first expansion chamber, and a cooling air flows through cooling pipe.

6 Claims, 3 Drawing Sheets

(56) References Cited

U.S. PATENT DOCUMENTS

| | | | | |
|---|---|---|---|---|
| 5,338,903 | A * | 8/1994 | Winberg | F01N 1/083 181/231 |
| 5,738,184 | A * | 4/1998 | Masuda | F01N 1/089 181/262 |
| 2003/0121722 | A1 * | 7/2003 | Crombeen | F01N 1/089 181/275 |

FOREIGN PATENT DOCUMENTS

| | | | |
|---|---|---|---|
| JP | 09-228836 | | 9/1997 |
| JP | 09228836 | A * | 9/1997 |

* cited by examiner

EXHAUST MUFFLER FOR COMBUSTION ENGINE

CROSS REFERENCE TO THE RELATED APPLICATION

This application is based on and claims Convention priority to Japanese patent application No. 2015-242579, filed Dec. 11, 2015, the entire disclosure of which is herein incorporated by reference as a part of this application.

BACKGROUND OF THE INVENTION

Field of the Invention

The present invention relates to a cooling structure in an exhaust muffler for decreasing the amount of noise emitted by the exhaust gases of a combustion engine.

Description of Related Art

JP Laid-open Patent Publication No. H09-228836, for example, discloses an engine system including a cooling fan adapted to be driven in association with an engine rotary shaft so that an engine cylinder can be cooled by a cooling air or air, in which a portion of the cooling air from the cooling fan is guided to cool an outer surface of a muffler.

It has, however, been found that with the cooling structure disclosed in the JP Laid-open Patent Publication No. H09-228836 referred to above, difficulty has been found in guiding the cooling air efficiently over the entire outer surface of the muffler. It has also been found that mere cooling of the outer surface is far from sufficiently cooling the muffler to the deepest region of the interior thereof.

SUMMARY OF THE INVENTION

In view of the foregoing, the present invention has been devised to provide a muffler for use with an engine, which muffler has a high cooling performance.

In order to accomplish the foregoing object, the muffler in accordance with one aspect of the present invention is a muffler for decreasing an amount of noise emitted by the exhaust gases of an engine, which muffler is provided with a cooling member configured to flow an external air through the muffler. The cooling member referred to above is, for example, a pipe.

According to the above discussed aspect of the present invention, the cooling member extends through a peripheral wall of the muffler, and an external air is allowed to pass through the cooling member. Accordingly, in addition to the outer surface of the muffler, the interior of the muffler can be effectively cooled. As a result thereof, the cooling performance of the muffler increases. With the cooling performance increased in the manner described above, it is possible to use, for example, a material relatively low in heat resistance and/or to reduce the plate thickness for a member constituting the peripheral wall of the muffler, resulting in an increase of the degree of freedom in designing.

In one preferred embodiment of the present invention, the cooling member referred to above may extend through a first expansion chamber on the most upstream side. According to this structural feature, the first expansion chamber in the muffler, where the highest possible temperature is attained, can be effectively cooled.

Where the cooling member referred to above extends through the first expansion chamber, a catalyst for substantially purifying the exhaust gases may be disposed between the first expansion chamber and a second expansion chamber on one side downstream thereof. If the catalyst is disposed between the first expansion chamber and the second expansion chamber, the first expansion chamber is further heated to a higher temperature along with the heating of the second expansion chamber, but this structural feature allows the first expansion chamber of the elevated temperature to be effectively cooled.

In another preferred embodiment of the present invention, the cooling member referred to above may extend in a direction conforming to a direction of flow of a cooling air from a cooling fan of the engine. According to this structural feature, since the cooling member extends in a direction conforming to the direction of flow of the cooling air, the cooling air can be effectively guided into the cooling member. As a result, the cooling performance of the muffler is increased.

In a further preferred embodiment of the present invention, an exhaust pipe having a downstream end closed may be connected while extending through a peripheral wall of the muffler, in which case a discharge port open into the muffler may be formed in a peripheral wall of the exhaust pipe, and the cooling member may be disposed in contact with or in the vicinity of the exhaust pipe. It is to be noted that the wording "the cooling member in the vicinity of the exhaust pipe" referred to above and hereinafter is intended to mean that the distance between the cooling member and the exhaust pipe is equal to or smaller than half the external diameter of the exhaust pipe. According to this structural feature, the exhaust pipe tending to have the elevated temperature and its vicinity can be effectively cooled.

In a further preferred embodiment of the present invention, the cooling member may be formed by a pipe. According to this structural feature, the cooling member can be easily produced.

In a still further preferred embodiment of the present invention, the engine may be provided with a carburetor. Where the carburetor type engine is not provided with a fuel cutting function that works at the time the engine is halted, afterburning phenomenon may be likely to occur in which unburned components of the fuel is burned at a high temperature zone within the muffler when the engine is halted. According to this structural feature, the occurrence of the afterburning phenomenon can be effectively avoided, since the interior of the muffler is cooled as well.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Figure 1:
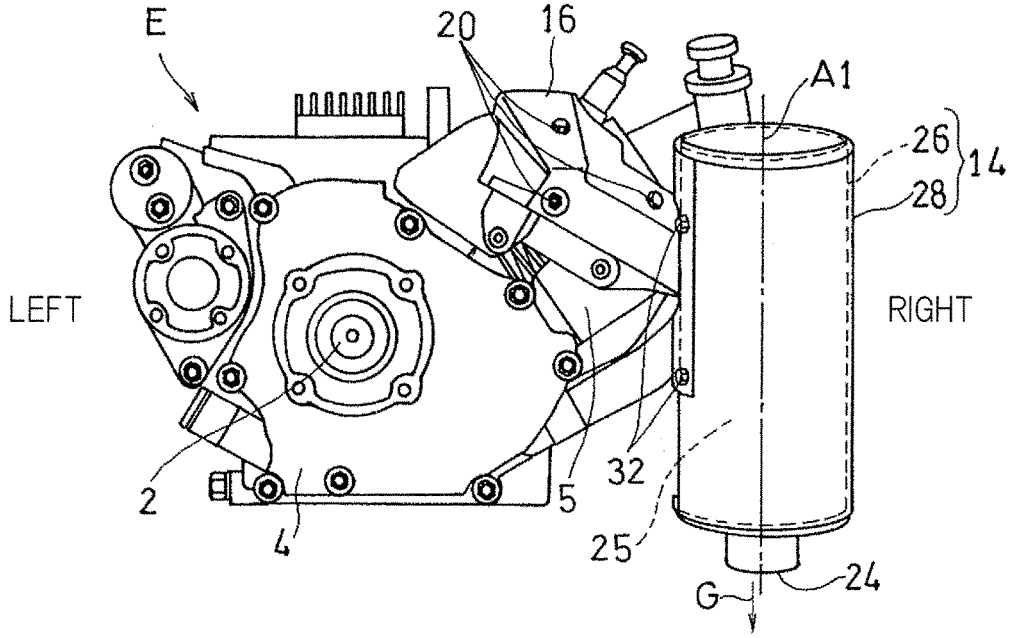
FIG. 1 is a front elevational view showing a combustion engine equipped with a muffler designed in accordance with a preferred embodiment of the present invention.
Figure 2:
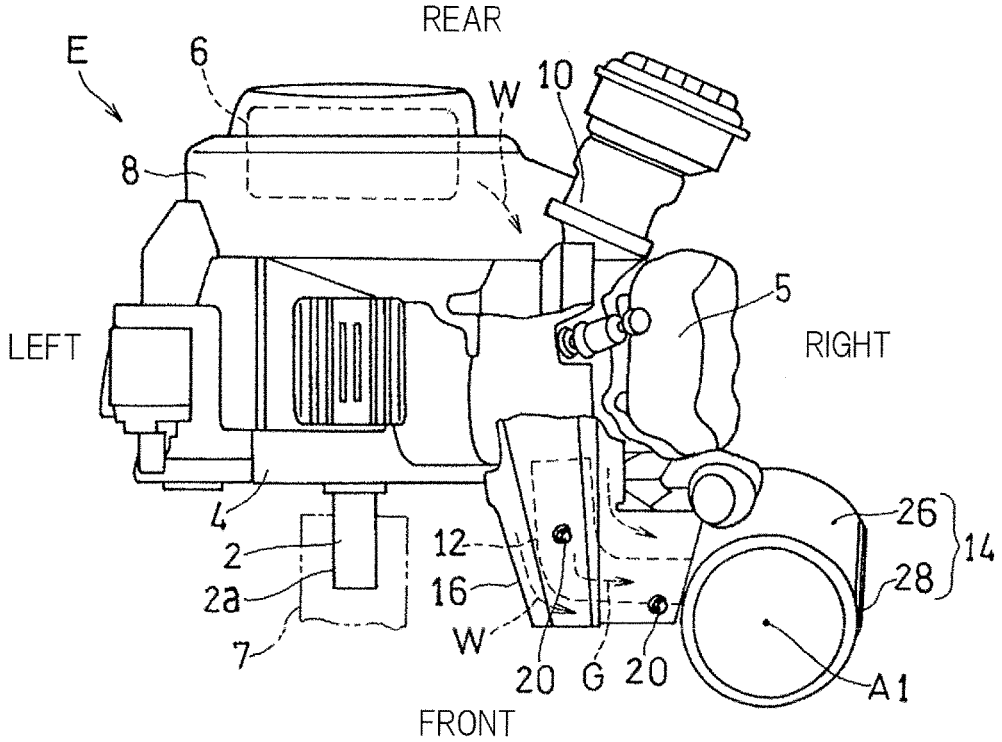
FIG. 2 is a top plan view showing the combustion engine.

Hereinafter a preferred embodiment of the present invention will be described in detail with particular reference to the accompanying drawings. In particular, FIG. 1 illustrates a front elevational view showing an engine equipped with a muffler designed in accordance with a first preferred embodiment of the present invention, and FIG. 2 illustrates a top plan view thereof. The illustrated engine E may be a combustion engine of a kind used in a farm machine, such as, for example, a rice planting machine that is driven and manipulated by a farmer. The combustion engine E shown in FIG. 1 includes a crankshaft 2, which is an engine rotary shaft, and an engine casing 4 for rotatably supporting the crankshaft 2. An engine cylinder 5 protrudes from a top portion of a right side of the engine casing 4 in a direction diagonally upwardly and rightwardly.

As shown in FIG. 2, the crankshaft 2 has a front end portion 2*a* protruding outwardly from the engine casing 4, and a load 7 such as, for example, an operating machine is relatively non-rotatably connected with the front end portion 2*a* of the crankshaft 2. The crankshaft 2 also has a rear end portion connected with a centrifugal cooling fan 6 that concurrently serves as a flywheel. An outer periphery of the cooling fan 6 is covered by a fan casing 8. The fan casing 8 is secured to the engine casing 4 by means of a bolt (not shown). A cool wind or cooling air W induced by the cooling fan 6 is, after having been guided by the fan casing 8, fed to the outer periphery of the engine cylinder 5.

The combustion engine employed in the practice of the preferred embodiment is an engine of a carburetor type. In other words, a carburetor 10 for mixing a fuel and an air together and then injecting the resultant air-fuel mixture into a combustion chamber within the engine cylinder 5 is fluid connected with an intake port (not shown) defined in a rear portion of the engine cylinder 5. On the other hand, a muffler 14 is fluid connected through an exhaust pipe 12 with an exhaust port (not shown) defined at a front portion of the engine cylinder 5. The muffler 14 operates to decrease the noise emitted by exhaust gases G of the combustion engine E.

The exhaust pipe 12 is in the form of a pipe made of a steel material and is fluid connected with the muffler 14 after extending forwardly from the engine cylinder 5 and being then curved substantially 90° in a rightward direction. In other words, the muffler 14 is disposed forwardly of and on a right side of the engine cylinder 5. The exhaust pipe 12 has an outer periphery covered by an exhaust pipe covering 16. Specifically, the exhaust pipe covering 16 covers regions upwardly, downwardly, forwardly and leftwardly of the exhaust pipe 12. This exhaust pipe covering 16 is fitted to fitting metal pieces 18 (best shown in FIG. 3), which are secured to an outer surface of the exhaust pipe 12, with the use of corresponding bolts 20. The exhaust pipe covering 16 concurrently serves as a guide member for guiding the cooling air W into the muffler 14. In other words, as shown in FIG. 3, a wind guiding passage 22 for guiding the cooling air W towards the muffler 14 is formed between the exhaust pipe 12 and the exhaust pipe covering 16.

Figure 4:
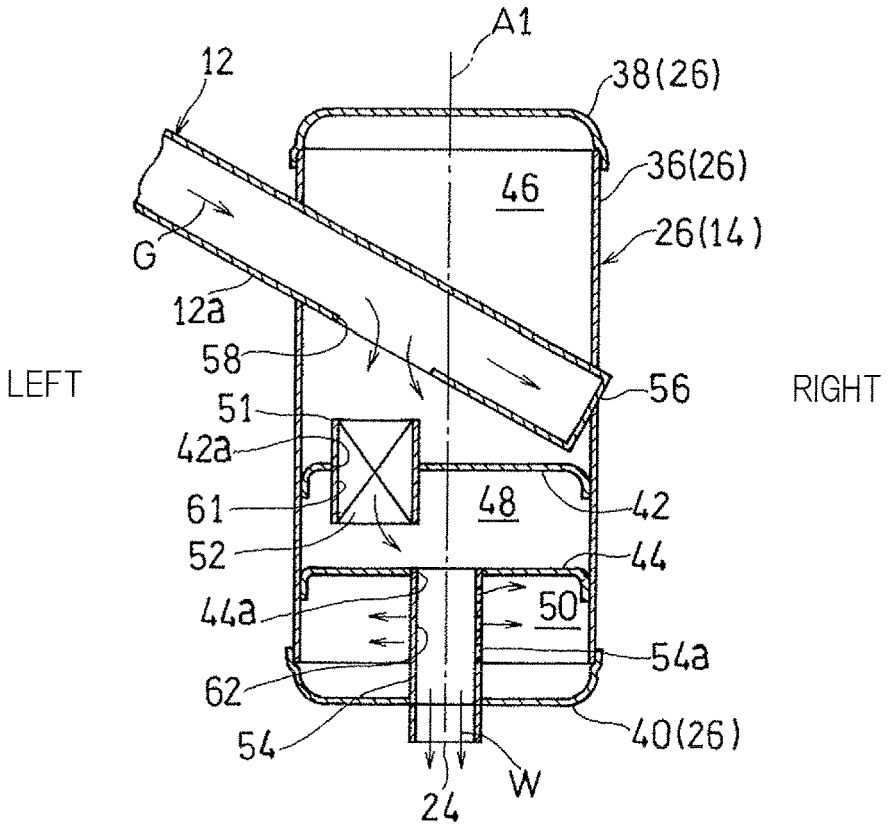
FIG. 4 is a cross sectional view taken along the line IV-IV in FIG. 3.

The muffler 14 is of a cylindrical shape having its axis A1 extending substantially in a vertical direction. As shown in FIG. 4, the muffler 14 has a top portion, with which the exhaust pipe 12 is fluid connected, and a lower portion formed with an outflow port 24. The muffler 14 includes a muffler main body portion 26, having a silencing chamber 25 defined therein, and a muffler covering 28 (FIG. 1) for covering an outer circumference of the muffler main body portion 26. Each of the muffler main body portion 26 and the muffler covering 28 are prepared from a steel plate.

Figure 3:
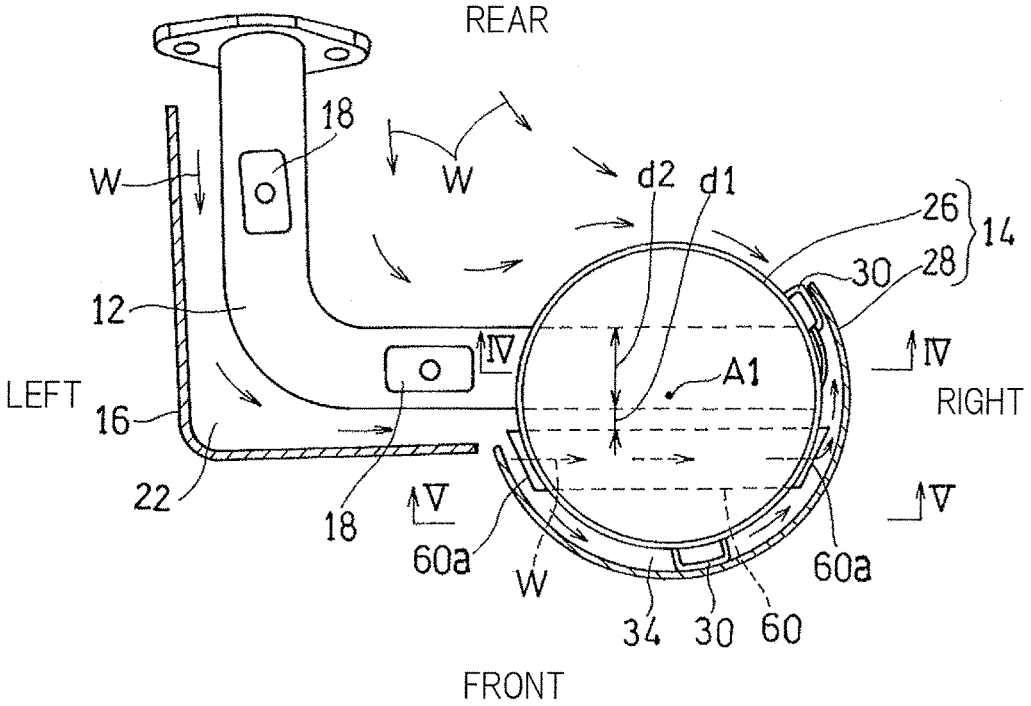
FIG. 3 is a top plan view showing the muffler as viewed from an axial direction thereof.

The muffler covering 28 covers a region upwardly and approximately half of the outer periphery of the muffler main body portion 26 and, more specifically, a region forwardly and a region rightwardly of the muffler main body portion 26 as shown in FIG. 3. The muffler covering 28 is fitted to fitting metal pieces 30, which are secured to an outer surface of the muffler main body portion 26 with the use of bolts 32 (best shown in FIG. 1). A cooling passage 34 is formed between the muffler main body portion 26 and the muffler covering 28. The cooling passage 34 has an upstream side fluid continued to a downstream side of the wind guiding passage 22.

As shown in FIG. 4, the muffler main body portion 26 includes a tubular body 36 of a cylindrical shape, having its opposite ends opened, a top lid 38 for closing the top opening of the tubular body 36, and a bottom lid 40 for closing the bottom opening of the tubular body 36. The tubular body 36, the top lid 38 and the bottom lid 40 are welded together by the use of any known welding technique. In other words, the tubular body 36 forms a peripheral wall of the muffler main body portion 26. A first partition wall 42 is secured to an inner peripheral surface of a lower portion of the tubular body 36, and a second partition wall 44 is secured to an inner peripheral surface of a lower portion of the tubular body 36 at a location below the first partition wall 42. In other words, the interior of the muffler main body portion 26 is divided by the first and second partition walls 42 and 44 into a first expansion chamber 46, a second expansion chamber 48 below the first expansion chamber 46, and a resonance chamber 50 defined below the second expansion chamber 48.

The first expansion chamber 46 is a space delimited by the top lid 38, the tubular body 36 and the first partition wall 42. The second expansion chamber 48 is a space delimited by the tubular body 36 and the first and second partition walls 42 and 44. The first and second expansion chambers 46 and 48 cooperate with each other to form the silencing chamber 25 referred to previously. The resonance chamber 50 is a space delimited by the bottom lid 40, the tubular body 36 and the second partition wall 44. It is, however, to be noted that the resonance chamber 50 may not be necessarily employed and may therefore be dispensed with.

The first partition wall 42 has a first throughhole 42*a* defined therein, and a first communicating passage 61 is formed by a pipe 51, inserted in the first throughhole 42*a*, to thereby fluid connect the first expansion chamber 46 and the second expansion chamber 48 with each other. In the practice of the embodiment now under discussion, the pipe 51 is welded to the first partition wall 42, and a catalytic converter 52 for substantially purifying the exhaust gases G is inserted in the first communicating passage 61 within the pipe 51. It is, however, to be noted that the use of the catalytic converter 52 is not necessarily essential and may therefore be dispensed with.

The second partition wall 44 has a second throughhole 44*a* defined therein, and a second communicating passage 62 is formed by a tail pipe 54, inserted in the second communicating hole 44*a*, to communicate the second expansion chamber 48 with the outside. The tail pipe 54 is secured to the second partition wall 44 by means of any known welding technique. The tail pipe 54 extends through the resonance chamber 50 and then through the bottom lid 40 so as to protrude towards the outside of the muffler main body portion 26, with an outer end thereof defining the outflow port 24 of the muffler 14. A region of a peripheral wall of the tail pipe 54, which extends through the resonance chamber 50, is formed with a plurality of third communicating holes 54*a* in communication with the resonance chamber 50.

The exhaust pipe 12 has a downstream portion 12*a* which extends through the peripheral wall of the tubular muffler 14, that is, one side portion (left side portion) of the tubular body 36. The downstream portion 12*a* is connected with the muffler main body portion 26. The downstream portion 12*a* of the exhaust pipe 12 extends slantwise downwardly within the interior of the muffler main body portion 26, specifically downwardly towards the other side portion (right side portion) of the first expansion chamber 46. A portion of a downstream end of the exhaust pipe 12 extends through the other side portion (right side portion) that is opposed to one side portion of the tubular body 36. The downstream end of the exhaust pipe 12 is closed by a closure member 56. The closure member 56 is in the form of, for example, a metal plate and is secured to the downstream end of the exhaust pipe 12 by means of any known securing technique such as welding.

At a site of the peripheral wall of the exhaust pipe 12 that is positioned within the first expansion chamber 46, a discharge port 58 is provided in communication with the first expansion chamber 46. The discharge port 58 communicates the interior of the exhaust pipe 12 with the first expansion chamber 46. The downstream portion 12*a* of the exhaust pipe 12 is secured to a left side portion and a right side portion of the tubular body 36 by means of any known welding technique. The discharge port 58 is formed in a lower portion of the downstream portion 12*a* of the exhaust pipe 12 so as to confront with the first partition wall 42.

Figure 5:
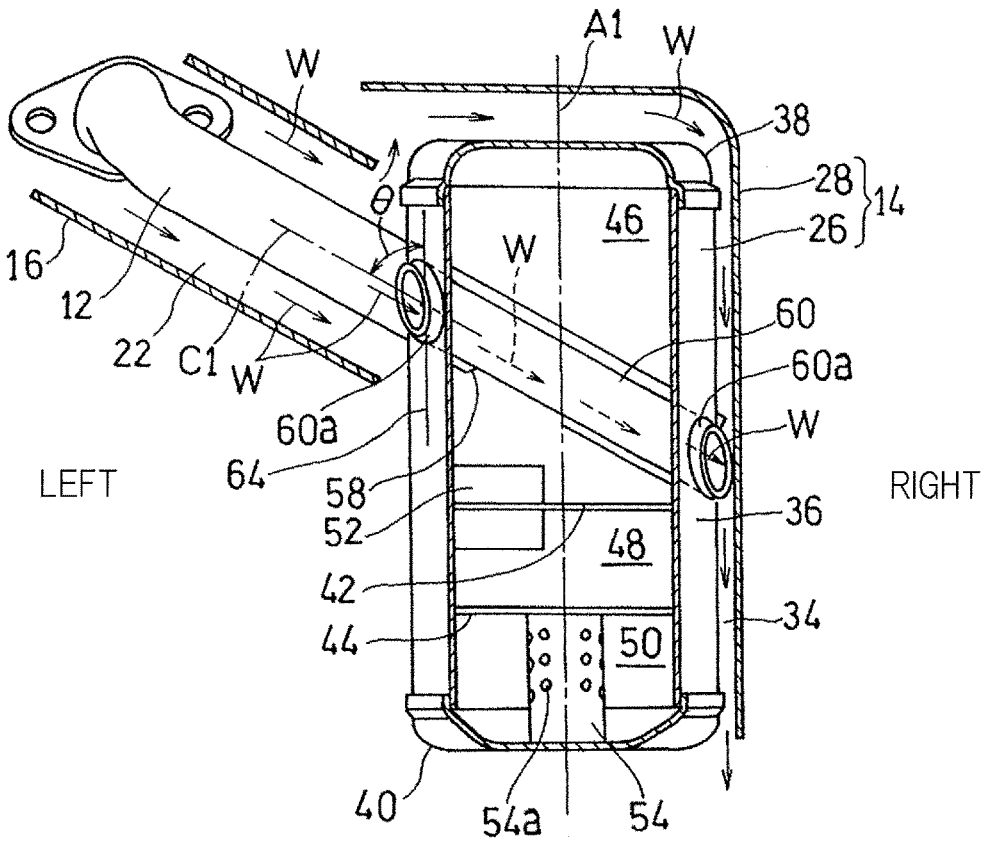
FIG. 5 is a cross sectional view taken along the line V-V in FIG. 3.

As shown in FIG. 5, the muffler 14 is provided with a cooling pipe 60 which is a sort of cooling member used to feed the cooling air W into the interior of the muffler 14 through the muffler main body portion 26. More specifically, the cooling pipe 60, after having passed through one side portion (left side portion) of the tubular body 36 of the muffler main body portion 26, extends through the first expansion chamber 46 of the muffler main body portion 26 and then extends through the other side portion (right side portion) of the tubular body 36. The cooling pipe 60 employed in the practice of the embodiment now under discussion is in the form of a cylindrical pipe made of a metallic material and having its opposite ends 60*a* and 60*a* open to the outside, and is fixed to the tubular body 36 by mean of any known welding in the vicinity of the opposite ends 60*a* and 60*a*.

It is, however, to be noted that the cooling member referred to above may not necessarily limited to the cylindrical pipe, provided that it is of a structure capable of feeding the cooling air W into the interior of the muffler 14 through the muffler main body 26. It is also to be noted that the cooling member may be a pipe of a kind having a transverse section, which is oval, rectangular, polygonal or any other shape, and that the use may be made of, for example, different members for the interior and the outside of the muffler 14, respectively, which different members are to be connected together by means of any known welding technique. Yet, the cooling member may be constituted by a plurality of members and, for example, the interior and the outside of the muffler main body portion 26 may be prepared from different members which have to be connected together by means of any known welding technique. In such case, the cooling member may be curved within the interior of the muffler main body portion 26 or the passage sectional area thereof may not be fixed.

The cooling pipe 60 extends in a direction conforming to the direction of flow of the cooling air W and, in the practice of the embodiment now under discussion, the cooling pipe 60 extends slantwise downwardly towards the right side. Also, the cooling pipe 60 is disposed in the vicinity of the exhaust pipe 12. It is to be noted that the wording "the cooling member in the vicinity of the exhaust pipe" referred to above and hereinafter is intended to mean that the distance d1 between the cooling pipe 60, shown in FIG. 3, and the exhaust pipe 12 is equal to or smaller than half the external diameter d2 of the exhaust pipe. It is also to be noted that the cooling pipe 60 may be disposed in contact with the exhaust pipe 12.

In the practice of the embodiment now discussion, the exhaust pipe 12 and the cooling pipe 60 are so disposed as to be parallel to each other. It is, however, to be noted that the present invention works satisfactorily provided that the exhaust pipe 12 and the cooling pipe 60 extend parallel to each other when viewed at least from above such as in FIG. 3, that is, the exhaust pipe 12 and the cooling pipe 60 are disposed parallel to each other when viewed from the nozzle axis A1, but may not be disposed parallel to each other when viewed from front such as in FIG. 4. The size (outer diameter) of the cooling pipe 60 shown in FIG. 5 and the angle θ of approach relative to the muffler main body portion 26, that is, the angle θ delimited between an axis C1 of the cooling pipe 60 and a generating line 64 of the muffler main body portion 26 are determined by securement of the wind guidance of the cooling air W, positional relationship with the exhaust pipe 12 or the like. Also, the number of the cooling pipe 60 may be two or more. The number of the cooling pipe 60 is determined in dependence on securement of the wind guidance of the cooling air W, the capacity of the silencing chamber 25 or the like. In the practice of the embodiment now under discussion, the angle θ of approach of the cooling pipe 60 is set to a value substantially equal to the angle of inclination of the wind guiding passage 22, but in order to enable the cooling air W to be smoothly introduced into the cooling pipe 60, it is preferable to set the angle θ of approach of the cooling pipe 60 within a range of such angle of inclination ±10° or smaller.

When the combustion engine E shown in FIG. 2 is started, the exhaust gases G discharged from the engine cylinder 5 flow through the exhaust pipe 12 and are then introduced into the muffler 14. The exhaust gases G flow from the discharge port 58 in the downstream end portion 12*a* of the exhaust pipe 12 shown in FIG. 4 into the first expansion chamber 46. After having been expanded within the first expansion chamber 46, the exhaust gases G, during the flow thereof through the first communicating passage 61 within the pipe 51, flow through the catalytic converter 52 and then flow into the second expansion chamber 48. During the flow through the catalytic converter 52, the exhaust gases G are substantially purified with carbon hydride, carbon monoxide and other components of the exhaust gases G having been oxidized.

After the exhaust gases G has been again expanded within the second expansion chamber 48, the exhaust gases G flow through the tail pipe 54 and are then discharged to the outside of the muffler 14. At this time, a portion of the exhaust gases G is discharged to the resonance chamber 50 through the third communicating hole 54*a* with the exhaust pulses consequently relieved.

On the other hand, when the combustion engine E shown in FIG. 2 is started, the crankshaft 2 rotates to drive the cooling fan 6. The cooling air W induced by the cooling fan 6 flows towards the engine cylinder 5 while having been guided by the fan casing 8. The cooling air W having passed around the outer periphery of the engine cylinder 5 is guided towards the muffler 14 while having been guided by the exhaust pipe covering 16.

As shown in FIG. 3, the cooling air W guided to the muffler 14 after having flown through the wind guiding passage 22 on an inner side of the exhaust pipe covering 16 is guided to the cooling passage 34 between the muffler main body portion 26 and the muffler covering 28. During the flow of the cooling passage 34, the cooling air W flows from a front surface of the muffler main body portion 26 along a right side surface thereof to thereby cool the outer surface of the muffler main body portion 26. Also, a portion of the cooling air W introduced into the cooling passage 34 flows from a left side portion of the muffler main body portion 26 into the interior of the cooling pipe 60 and then flow towards a right side portion of the muffler main body portion 26 after having passes through the interior of the cooling pipe 60. On the other hand, another portion of the cooling air W having flown through the engine cylinder 5 (best shown in FIG. 2) flows from a rear of the exhaust pipe 12 towards a rear surface of the muffler main body portion 26 to cool a rear side of the outer surface of the muffler main body portion 26.

In the construction as hereinabove described, the flow of the cooling air W through the cooling pipe 60 shown in FIG. 5 is effective to cool not only the outer surface of the muffler main body portion 26, but also the interior of the muffler main body portion 26 effectively. As a result thereof, the cooling performance of the muffler 14 increases.

In the practice of the embodiment now under discussion, it has been found that the internal temperature of the first expansion chamber 46, which has been about 250° C. when the outside temperature was 25° C., was decreased by about 60° thanks to the use of the cooling pipe 60. Consequent upon the increase of the cooling performance of the muffler 14 as hereinbefore discussed, it is possible to use a material having a relatively low heat resistance for the plate member forming the muffler main body portion 26 and to reduce the plate thickness of the plate member forming the muffler main body portion 26 and, hence, the degree of freedom of designing increases.

Also, the cooling pipe 60 extends through the first expansion chamber 46 on the most upstream side. Since the first expansion chamber 46 is a region where the highest temperature is attained within the interior of the muffler main body portion 26, the use of the cooling pipe 60 in the first expansion chamber of that kind referred to above is beneficial to allow the muffler main body portion 26 to be cooled effectively.

Also, since the catalytic converter 52 is disposed between the first expansion chamber 46 and the second expansion chamber 48, in addition to the second expansion chamber 48 attaining the high temperature, the first expansion chamber 46 is further heated to a high temperature. However, the use of the cooling pipe 60 in the manner described above is effective to cool the first expansion chamber 46, then at the elevated temperature.

The cooling pipe 60 extends in a direction conforming to the direction of flow of the cooling air W. Accordingly, the cooling air W can be efficiently introduced into the interior of the cooling pipe 60. As a result thereof, the cooling performance of the muffler 14 is further increased.

Yet, since the cooling pipe 60 is disposed in the vicinity of the exhaust pipe 12, the exhaust pipe 12 and its vicinity, where a high temperature is attained, can be cooled effectively.

The combustion engine E shown in FIG. 2 is a carburetor type engine. Where the carburetor type engine has no function of fuel cutting at the time the engine is halted, if the interior of the muffler 14 is elevated in temperature at the time the engine is halted, there is a risk that afterburning phenomenon may occur in which unburned components of the fuel burn. In the practice of the embodiment now under discussion, however, thanks to the use of the cooling pipe 60 shown in FIG. 5, the interior of the muffler 14 is also cooled and, therefore, the occurrence of the afterburning phenomenon can be avoided.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the preferred embodiment of the present invention the use of two silencing chambers 25 has been shown and described, the present invention is not necessarily limited thereto and the only silencing chamber or three or more silencing chambers can be used. Also, the use of the catalytic converter 52 may not be essential in the present invention and may therefore be dispensed with.

Although the muffler of the present invention can be suitably applied to the carburetor type engine having no function of fuel cutting at the time the engine is halted, the muffler of the present invention can be equally applied to the carburetor type engine having the fuel cutting function or a combustion engine of a fuel injection system.

In addition, although the present invention has been shown and described as applied to the engine for use in the agricultural machine, the muffler of the present invention can be equally applied to the engine used in any passenger transporting vehicle other than the agricultural machine or to the engine of a ground installation type.

Accordingly, such changes and modifications are, unless they depart from the scope of the present invention as delivered from the claims annexed hereto, to be construed as included therein.

REFERENCE NUMERALS

6 . . . Cooling fan
12 . . . Exhaust pipe
14 . . . Muffler
36 . . . Tubular body (Peripheral wall of the muffler)
46 . . . First expansion chamber
48 . . . Second expansion chamber
52 . . . Catalyst converter (Catalyst)
58 . . . Discharge port
60 . . . Cooling pipe (Cooling member)
E . . . Combustion engine
G . . . Exhaust gas
W . . . Cooling air

What is claimed is:

1. A muffler to decrease an amount of noise emitted by exhaust gases of an engine, the muffler comprising:

a muffler main body portion having a silencing chamber defined therein;

a muffler covering configured to cover an outer circumference of the muffler main body portion;

a cooling passage formed between the muffler main body portion and the muffler covering; and a cooling pipe configured to flow an external air through the muffler, wherein the cooling pipe passes through a peripheral wall of the muffler main body portion, and has opposite ends open to the outside of the muffler, and the opposite ends of the cooling pipe are open to the cooling passage.

2. The muffler as claimed in claim 1, further comprising a first expansion chamber defined therein, wherein the cooling pipe extends through the first expansion chamber.

3. The muffler as claimed in claim 2, further comprising:

a catalyst configured to substantially purify the exhaust gases; and a second expansion chamber on one side downstream of the first expansion chamber, wherein the catalyst is disposed between the first expansion chamber and the second expansion chamber.

4. The muffler as claimed in claim 1, wherein the engine comprises a cooling fan to provide a cooling air, and the cooling pipe extends in a direction conforming to a direction of flow of the cooling air from the cooling fan of the engine.

5. The muffler as claimed in claim 1, wherein the engine comprises:

an exhaust pipe having a downstream end closed, the exhaust pipe being connected with the muffler while extending through the peripheral wall of the muffler main body portion; and a discharge port open into the muffler, which port is formed in a peripheral wall of the exhaust pipe, and the cooling pipe is disposed in the vicinity of the exhaust pipe.

6. The muffler as claimed in claim 1, wherein the engine is provided with a carburetor.

* * * * *